US005687748A

United States Patent [19]

Conrad et al.

[11] Patent Number: 5,687,748

[45] Date of Patent: Nov. 18, 1997

[54] SPOOL AND SHELL WITH PRESSURIZING FLUID ACTIVATED SEAL

[75] Inventors: Lucas Jones Conrad; Robert Eugene Grubbs; James Edward Lovette, all of Winston-Salem, N.C.

[73] Assignee: R. J. Reynolds Tobacco Company, Winston-Salem, N.C.

[21] Appl. No.: 674,001

[22] Filed: Jul. 1, 1996

[51] Int. Cl.[6] ..... A24B 3/18

[52] U.S. Cl. ..... 131/291

[58] Field of Search ..... 131/291–296

[56] References Cited

U.S. PATENT DOCUMENTS 4,554,932 11/1985 Conrad et al. ..... 131/296

5,469,872 11/1995 Beard et al. ..... 131/291

*Primary Examiner*—Jennifer Bahr

[57] ABSTRACT

A process and apparatus for tobacco expansion is employed for expanding tobacco at rapid throughput rates. The apparatus includes a spool and shell assembly wherein the spool is moveable within the shell between loading, impregnating, and unloading positions. In the impregnating position, sealing assemblies seal the radial clearance between shell and the end members of the spool to provide a pressure vessel for tobacco impregnation. The sealing assemblies includes at least one elastically deformable sealing ring associated with the circumferential exterior of the end member. A pressure applying member is operatively associated with an axial end of each of the sealing members to releasably impart axial pressure onto the axial end of the sealing member when the spool is in the treating position to cause radial expansion of the deformable sealing ring and thereby accomplish sealing of the spool within the shell.

25 Claims, 5 Drawing Sheets

SPOOL AND SHELL WITH PRESSURIZING FLUID ACTIVATED SEAL

FIELD OF THE INVENTION

The invention relates to a pressure vessel and to processes for high pressure fluid treatment and, preferably, processes for treating tobacco with a high pressure fluid, including processes for increasing the filling capacity of tobacco, extraction processes, and other processes in which the treatment of a material at elevated pressure is required.

BACKGROUND OF THE INVENTION

The apparatus and process of the invention are particularly desirable in connection with tobacco expansion processes, i.e. processes for increasing the filling capacity of tobacco. Tobacco expansion processes are used to restore tobacco bulk density and/or volume which are lost during curing and storing tobacco leaf. In addition, expanded tobacco is an important component of many low-tar and ultra low-tar cigarettes.

In current commercial processes for impregnating tobacco with an expansion agent under high pressure, for example, from 200 psig and above, the pressure vessel required is quite bulky, having heavy portable lids to withstand the pressure. The seal mechanisms for the lids are specially designed to withstand the high pressures. These types of pressure vessels, which are generally referred to as autoclaves, normally have a cylindrical body portion with convex ends, one or both ends being removable to permit loading and unloading.

One goal in any process is to increase material throughput. However, most tobacco expansion processes include a high pressure impregnation step along with other steps which cannot be carried out at high pressure. This, in turn, requires that pressure be released at some point and the treated tobacco removed from the pressure vessel. As a result, the infeed and outfeed to and from the pressure treatment step is a limiting factor in improving efficiencies in high pressure tobacco treatment processes. Thus, tobacco expansion processes employing a high pressure impregnation step are limited in their throughput efficiencies by the equipment used, particularly the pressure vessel.

Specifically, in tobacco expansion processes, a volatile tobacco expansion agent is introduced into the cellular structure of the tobacco which has collapsed due to the curing process. Generally, this step is referred to as impregnation. The impregnated tobacco is then exposed to conditions causing the expansion agent to rapidly volatilize, causing the tobacco cell to expand as the compound is driven out of the cell in a gaseous or vaporous state. Volatilization of the expansion agent is accomplished by heating the impregnated tobacco in many cases or by rapidly reducing pressure in other cases. There are a number of processes which utilize these basic concepts with different expansion agents, some of which are disclosed in U.S. Pat. No. Re. 30,693, U.S. Pat Nos. 3,524,452; 3,771,533; and 4,531,529; British Patent Specification No. 1,484,536 and Canadian Patent No. 1,013,640.

The amount of pressure used to impregnate the tobacco generally depends on the particular expansion agent employed. U.S. Pat. No. 3,524,452 to Stewart et al. discloses a process in which a relatively low pressure can be used because the impregnant is normally in a condensed state at these pressures, while Canadian patent No. 1,013,640 and British Patent Specification No. 1,484,536, which disclose processes which use carbon dioxide as the impregnating compound, and require a much higher pressure to ensure that carbon dioxide is introduced into the tobacco cells in sufficient quantity to cause expansion of the cells when the impregnated tobacco is heated.

Some of the drawbacks of using any of these and other prior art high pressure systems are the bulkiness of the autoclave and lids, the difficulties with sealing the system, the special basket or container required to hold tobacco, and apparatus associated with loading and unloading tobacco into and out of the pressure vessel.

U.S. Pat. No. 4,554,932 to Conrad and White, incorporated herein by reference, describes a fluid pressure treating apparatus including a tubular shell housing a spool assembly. The spool includes a connecting rod that is preferably of relatively small diameter, that extends between two cylindrical spool ends. The spool ends have a diameter greater than the connecting rod, but less than the inner diameter of the tubular shell. The spool is mounted for reciprocating movement between a loading position outside the shell, a treating position within the shell, and an unloading position outside of the shell. When the spool is within the tubular shell, deformable sealing rings carried in annular grooves on the spool ends are forced radially outwardly for engagement with the interior wall of the shell. This provides a sealed, annular-shaped pressure chamber inside the shell, in the space between the spool ends and surrounding the smaller spool body. When the spool is in this sealed treating position, one or more ports through the shell are transversely aligned with conduit shaped cavities extending radially into one or both spool ends and axially along the spool body, to allow input and removal of processing fluids into and from the annular space around the connecting rod between the spool ends inside of the shell.

U.S. patent application No. 08/163,049 filed Dec. 6, 1993, to Beard et al., entitled Tobacco Expansion Process and Apparatus, now U.S. Pat. No. 5,469,872 describes an apparatus and process for expanding tobacco at rapid throughput rates employing high pressure tobacco impregnation conditions. A preferred apparatus according to that invention employs the concepts of the pressure vessel including the spool and shell assembly of U.S. Pat. No. 4,554,932 set forth above. An improved spool assembly disclosed therein includes resiliently deformable sealing rings attached in annular grooves about the periphery of the end members of the spool, as well as wear rings to narrow the annular space or gap between the spool assembly and the shell. These sealing rings are integral with the wear rings and are exposed to a high pressure fluid, typically a food grade vegetable oil, on their inside circumferential surface to cause the rings to expand radially outwardly to accomplish their sealing function.

Although the spool and shell pressure vessel produces substantial time savings and improve economics in tobacco expansion, the fluid used to expand the sealing rings must be ported to the sealing rings by providing blind ports within the spool body. Moreover, the rings must be periodically replaced by removing the old rings and bonding new rings to the spool body. This is time consuming and costly. Further, if the resiliently deformable ring pressure fluid such as vegetable oil, leaks onto the tobacco, usefulness of the tobacco in the manufacture of cigarettes is impaired.

SUMMARY OF THE PRESENT INVENTION

This invention provides an improved spool assembly and an improved high pressure tobacco treatment process, preferably of the type disclosed in U.S. Pat. No. 4,554,932 to Conrad and White, and in the process and apparatus of U.S. patent application Ser. No. 08/163,049, filed Dec. 6, 1993, by Beard et al and now U.S. Pat. No. 5,469,872, and U.S. patent application Ser. No. 08/076,535, filed Jun. 14, 1993, by Conrad and White, now U.S. Pat. No. 5,483,977. The present invention provides an enhanced spool and shell pressure vessel including a sealing assembly that can improve operation of the spool and the apparatus, simplify its construction and/or improve the long term reliability thereof, while also improving the ease of replacing worn sealing elements.

An improved spool and shell assembly according to one aspect of the invention comprises a pressure vessel defined by a tubular shell and a spool assembly moveable between at least a first position outside the shell and a treating position within the shell. The spool assembly includes two cylindrical end members joined by a connecting rod. At least one sealing assembly is carried by each of the spool end members. The sealing assemblies seal the spool ends when the spool is in the treating position within the shell. Each of the sealing assemblies includes at least one elastically deformable sealing member, preferably a sealing ring, associated with the circumferential exterior of the end member. An axial pressure applying member is operatively associated with an annular end of each of the sealing rings to releasably impart axial pressure onto the annular end of the sealing member when the spool is in the treating position to cause radial extrusion, i.e., an increased size in the radial dimension, of the deformable sealing ring and thereby accomplish sealing of the spool within the shell.

Preferably, the pressure applying member is an annularly shaped member positioned axially adjacent the sealing member. It is also preferred that the fluid tobacco expansion agent be used to apply fluid pressure to the pressure applying member to achieve radial expansion of the sealing ring. Advantageously, a first annular end surface of the annular shaped pressure applying member contacts the sealing ring and has a smaller surface area than a second annular end surface of the pressure applying member which, in turn, is in fluid communication with the expansion agent. As a result, the pressure applying member applies a contact pressure to the sealing ring which is greater than the fluid pressure of the expansion agent, itself.

In another aspect of the present invention, the spool is advantageously formed of one or more radially central component or components supporting a plurality of discreet annular components, the latter including the sealing assemblies. With this construction, the annular sealing members can easily be replaced. One preferred component spool includes a radially central spool body forming the connecting rod between the end members and also a core portion of both end members of the spool. A retaining member associated with the axial end of each end member retains the annular sealing assembly components on the radially central spool body. Replacement of worn sealing members can be achieved simply by removal of the retaining members allowing the sealing assemblies to then be easily removed from the main spool body for replacement of the worn sealing rings.

BRIEF DESCRIPTION OF THE DRAWINGS

In the drawings, which form a portion of the original disclosure of the invention.

DETAILED DESCRIPTION OF THE PREFERRED EMBODIMENT

The present invention will now be described more fully in detail with reference to the accompanying drawings, in which the preferred embodiments of the invention are shown. This invention should not, however, be construed as limited to the embodiment set forth herein, rather they are provided so that this disclosure will be thorough and complete and will fully convey the scope of the invention to those skilled in the art.

Figure 1:
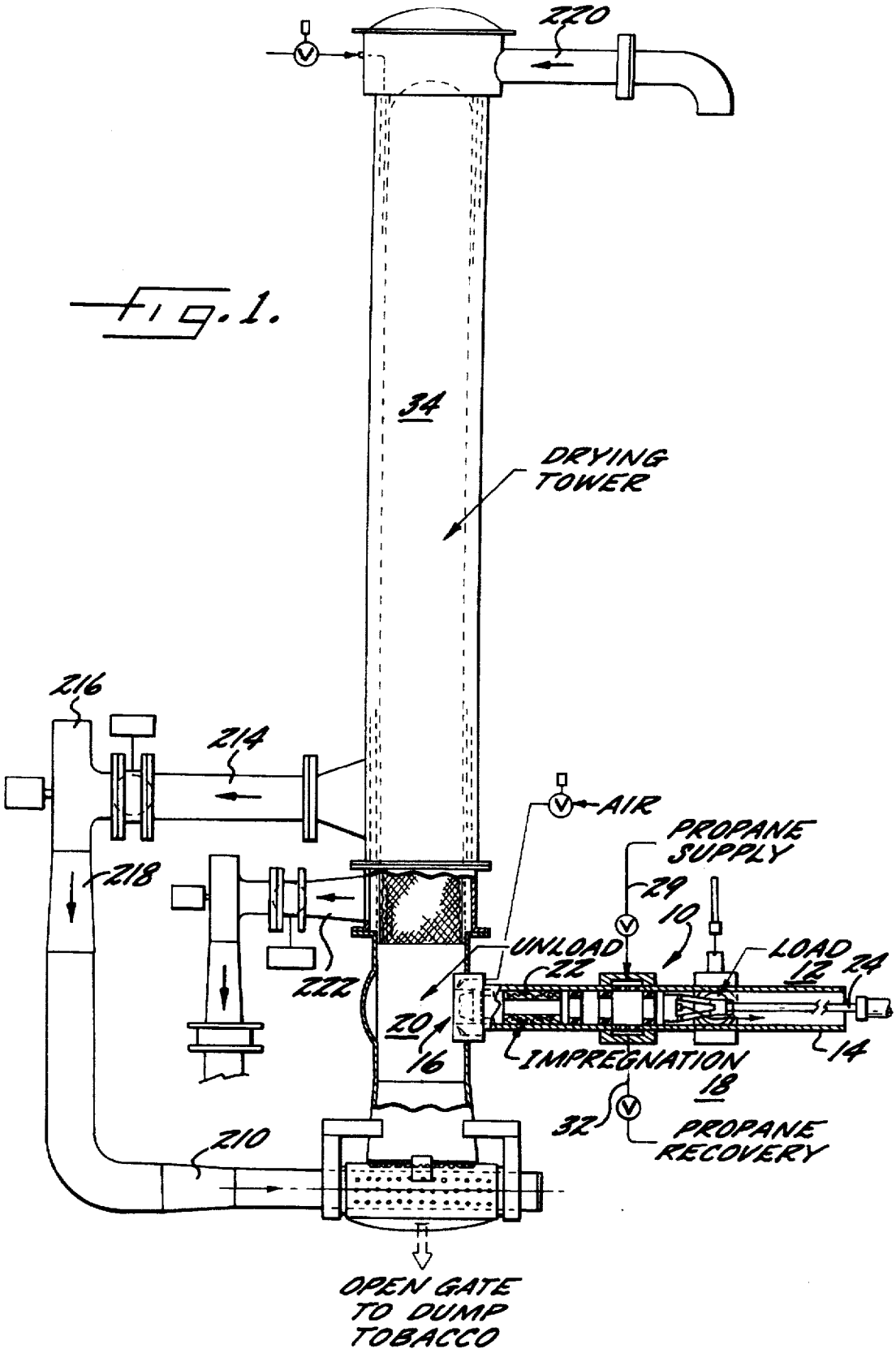
FIG. 1 is a schematic view of one advantageous tobacco expansion system including a preferred embodiment of an improved reciprocating spool and shell pressure chamber apparatus according to the present invention.

FIG. 1 is a schematic illustration of one advantageous embodiment of a tobacco expansion system and process which utilizes a preferred spool and shell assembly 10 according to the present invention. The spool and shell apparatus is generally constructed in accordance with U.S. Pat. No. 4,554,932, issued Nov. 26, 1985 to Conrad and White; and pending U.S. patent applications Ser. Nos. 08/163,049 of Beard, et al., filed Dec. 6, 1993, and 08/076,535 of Conrad and White, filed Jun. 14, 1993, the entire disclosures of which are herein incorporated by reference. Various details disclosed in the above disclosures are not repeated herein for the sake of brevity. However, reference may be had to the complete disclosures thereof for such details.

In the apparatus of FIG. 1, tobacco which has been preferably first treated in a single or series of preparation zone(s) (not shown) to increase its moisture content to a value above about 16% by weight, preferably above about 20% by weight, and also to increase its temperature substantially above ambient temperature, is fed to a loading zone 12. The loading zone 12 defines a loading position for a reciprocating spool and shell high pressure fluid treating apparatus 10. The spool and shell high pressure fluid treating apparatus 10 includes a cylindrical shell or enclosure 14 and a spool assembly 16 which is movable between the loading position 12, an impregnation unloading position 18 and an unloading position 20. The spool assembly 16 is illustrated in FIG. 1 positioned in the impregnating position 18 wherein the spool assembly is fully enclosed within the tubular shell 14. In this position a pressure chamber 22 is formed in the annular space within the shell 14 surrounding a portion of the spool assembly 16.

Figures 2, 3:
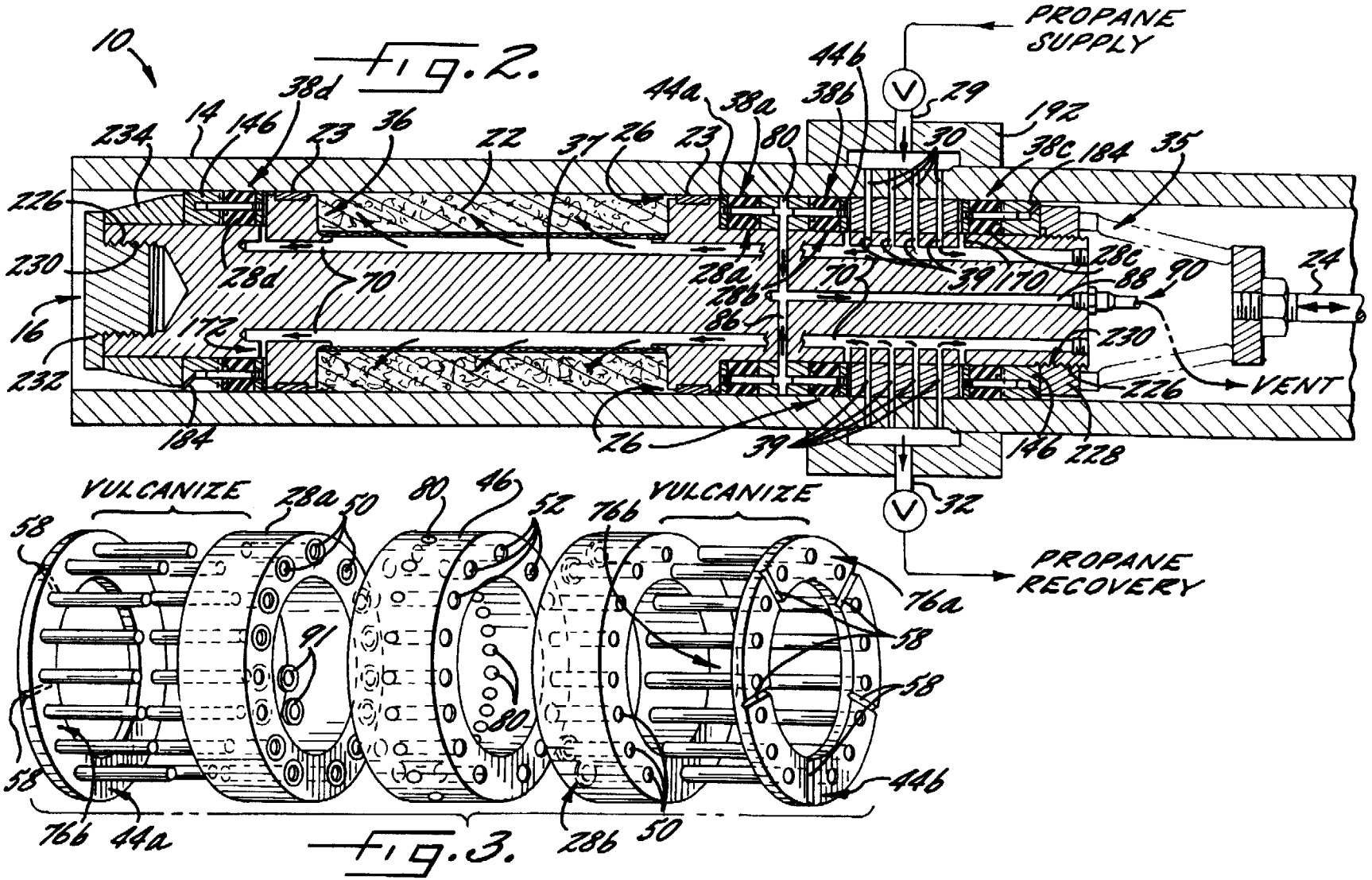
FIG. 2 is a detailed sectional view of the spool and shell assembly of FIG. 1 and illustrating the spool in a treating position within the shell.
FIG. 3 is an exploded view taken in perspective, of a preferred sealing assembly associated with one end member of the spool body of FIG. 2.

The shell 14 and spool assembly 16, best seen in FIG. 2, can be made of any suitable materials, including stainless steel and the like. Preferably, a plurality of wear rings 23 made of a bearing alloy such as a bearing grade of bronze e.g. an aluminum-bronze alloy, or a similar material softer than the shell 14 are provided around the circumferential surfaces of the spool ends so that the interior surface of the shell 14 is not damaged as the spool is moved within the shell. The specific materials, construction, and size of the shell and spool will be sufficient to withstand the pressures contemplated with the pressure vessel, as will be apparent.

Returning to FIG. 1, the spool is loaded with tobacco at the loading position 12 using various processes or apparatus including the apparatus described in U.S. Pat. No. 4,554,932. In a preferred embodiment, the tobacco is loaded onto the spool 16 employing the process and apparatus set forth and described in U.S. application Ser. Nos. 08/163,049 and 08/076,535, previously set forth. The tobacco can be provided any of various forms, including the form of leaf (including stem and veins), strips (leaf with the stem removed), cigar filler, cigarette cut filler (strips cut or shredded for cigarette making), or the like, preferably cut filler tobacco. Preferably the tobacco moisturized by any of various means known to those skilled in the art to a moisture content of at least about 12% and preferably at least about 20%. The tobacco is also preferably preheated to a temperature above ambient, and is then loaded into the annular space 22 of the spool 16, preferably under conditions such that the tobacco is compressed thereon to a density of 125% or greater as compared to the loose fill density of the same tobacco, typically the tobacco can be packed to a density of 20–30 pounds per cubic foot.

After loading of the tobacco at position 12, the spool assembly is moved via connecting rod 24 to the impregnating position 18 shown in FIG. 1. In order for the spool 16 to be moved within the shell 14, i.e., from the loading position to an impregnating position and then to an unloading position, it is important that there be at least a small annular gap or clearance 26 (see FIG. 11) between the inner circumferential surface of the shell and the outermost circumferential surface of the spool 16. When the spool 16 reaches impregnation position 18, a portion of the gap 26 is closed by radial expansion of a plurality of sealing members **28*a*–28*d*, shown in FIG. 2, in order to provide a pressure chamber 22 between the spool and shell 14**.

Once the spool is in the impregnation position, shown in FIG. 2, a tobacco expansion agent, preferably propane, is admitted to the impregnation chamber 22 via supply pipe 29 and ports 30 through the shell 14, and following an appropriate impregnation time which can be as short as one to several seconds, propane is removed via a recovery pipe 32, which can be the same as supply pipe 29 if desired. The sealing members **28*a*–28*d*, discussed below, are then relaxed and contracted radially and the spool assembly 16 is moved to the unloading position 20 illustrated schematically in FIG. 1. In one preferred embodiment, the tobacco is unloaded while undergoing substantially simultaneous expansion in a drying tower 34** (FIG. 1) which removes excess moisture from the expanded tobacco to stabilize expansion thereof. However, numerous and various other apparatus and processes can be used to recover and or treat the expanded tobacco as will be apparent.

FIG. 2 illustrates in detail the shell and spool assembly in the impregnating position. The spool assembly 16 includes cylindrically shaped end members 35 and 36 and a connecting rod 37. When the spool 16 is within the shell 14, the end members 35 and 36 together with the connecting rod 37 and the shell define an annular space 22 of predetermined volume constituting a sealed pressure chamber or vessel. The spool assembly 16 is mounted for reciprocating movement among the various positions shown in FIG. 1 including the loading position 12, the impregnating position 18 and the unloading position 20, by any of various arrangements and is preferably moved by a fast acting hydraulic cylinder (not shown) which is operatively connected to the spool via the axially oriented shaft or rod 24 partially shown in FIG. 1 and FIG. 2.

The spool 16 illustrated in FIG. 2 includes four sealing assemblies **38*a*–38*d* arranged on the circumferential periphery of the two spool end members 35 and 36. One of the end members 35 includes a plurality of radially oriented ports 39 for inlet and outlet of expansion agent to and from impregnation zone 22. Three sealing assemblies 38*a*, 38*b*, and 38*c*, are located on the radially ported end member 35 while only a single sealing assembly 38*d* is located on the other spool end member 36. This placement provides an individual sealing assembly adjacent each axial end of the two areas of the spool body 16 at which high pressure expansion agent communicates with the circumferential exterior of the spool body 16; namely the chamber area 22 between the end members, and the circumferential exterior portion of end member 35 defined by the ports 39 which provide entry and exit of the expansion agent. Although this positioning of the sealing assemblies is a preferred embodiment, the present invention is not limited to this precise placement or this exact number of sealing assemblies 38** as will be apparent.

Figure 4:
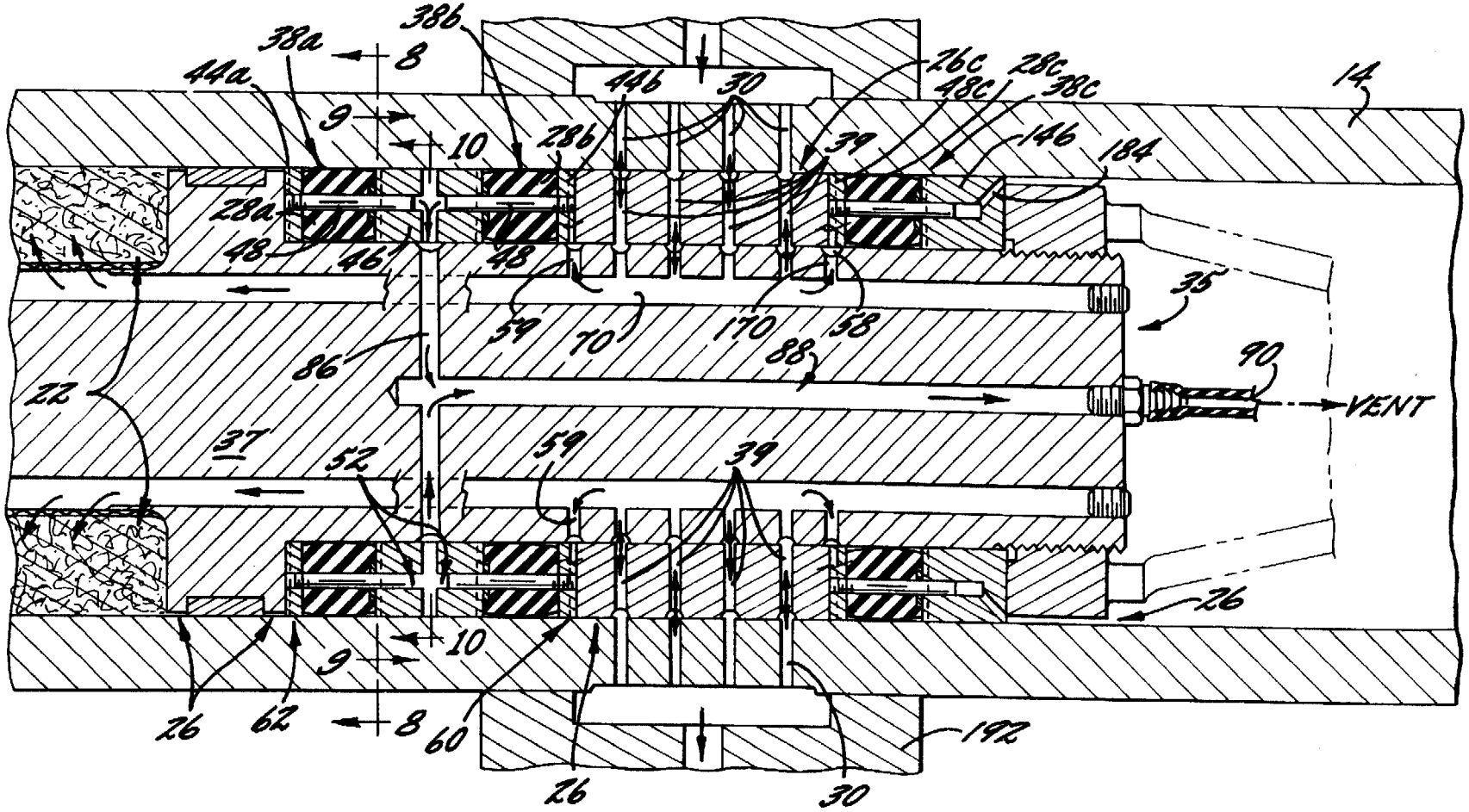
FIG. 4 is an enlarged detailed sectional view of one end portion of the spool body of FIG. 2 positioned within the shell assembly.

End member 35 is shown in FIG. 4. Two of the sealing assemblies, **38*a* and 38*b* on end member 35 are located axially between the pressure chamber 22 and the expansion agent ports 39. Each of these sealing assemblies 38*a* and 38*b*, includes an elastically deformable annular sealing member 28*a* and 28*b* and a corresponding compression member 44*a* and 44*b* contacting an annular end of the sealing member. Positioned axially between the two sealing members 28*a* and 28*b* is an annularly shaped abutment member 46 which spaces the sealing rings 28*a* and 28*b* from each other and provides an abutment surface for each of the sealing rings 28*a* and 28*b* as they are compressed by the compression members 44*a* and 44*b*. A plurality of axially oriented pins 48 are fixedly attached to each compression member 44*a* and 44*b*. The pins 48 extend axially from the annular end face of the compression member which faces its respective sealing member 28*a* and 28*b*. The pins 48 extend into and/or through axially aligned apertures 50** (see FIGS.

Figure 9:
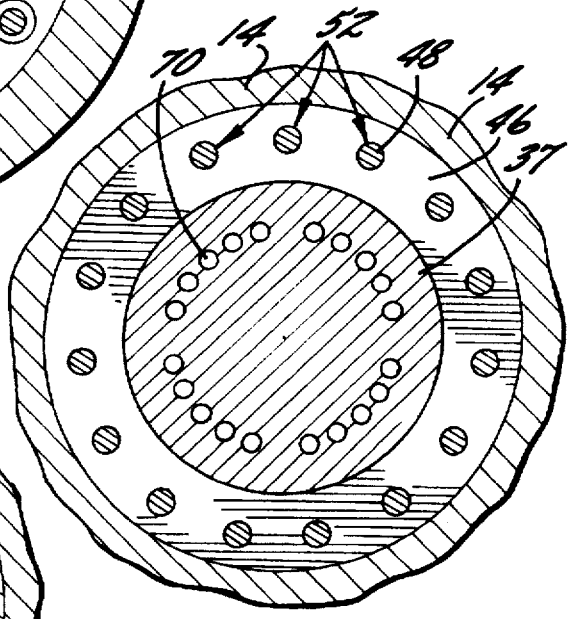
FIG. 9 is a partial cross-sectional view taken along line 9—9 of FIG. 4 illustrating a plurality of cavities provided in the annular end face of a rigid, annular spacer abutment member. Preferably, the spaces receive alignment pins attached to the compression members.
Figure 10:
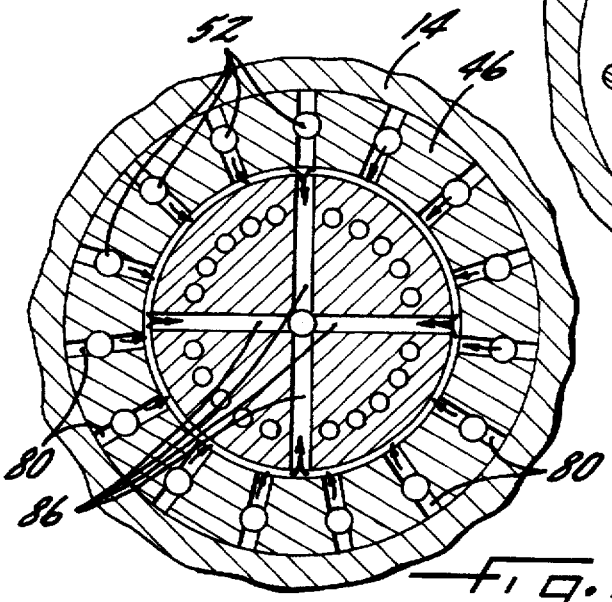
FIG. 10 is a cross-sectional view taken along line 10—10 of FIG. 4 illustrating fluid receiving ports within the annular spacer, abutment members, which are fluidly connected to ports within the spool body to permit exit of high pressure fluid from the annular space surrounding the annular spacer abutment member and between the two sealing rings as shown in FIG. 9.

3 and 8) extending through the sealing members 28a and 28b. The pins 48 can also extend through a portion of axially aligned apertures 52 (FIGS. 3, 9 and 10) formed in the annular spacer, abutment member 46.

As best seen in FIG. 4, the two sealing assemblies 38a and 38b are positioned within an annular groove formed in the circumferential exterior of the end member 35 such that the circumferentially exterior surface of each sealing member 28a and 28b forms a portion of the circumferentially exterior surface of the end member 35. As best seen in FIG. 3 each of the compression members 44a and 44b includes one or more radial channels 58 formed in the annular end surface thereof which faces away from its respective sealing member 28a and 28b. The radial channels 58 in compression member 44a receive high pressure expansion agent from impregnation zone 22, as discussed below, and thus allow entry of high pressure expansion agent into a space 60 shown in FIG. 11, which is located axially between compression member 44a and an adjacent shoulder portion 64 (also seen in FIG. 11), of end member 35. The corresponding radial channels 58 in compression member 44b receive high pressure expansion agent from radial ports 59 (FIG. 4) formed in the end member 35 and thus allow entry of high pressure expansion agent into space 62, (shown in FIG. 11), which is located axially between compression member 44b and an adjacent shoulder portion 66, (also seen in FIG. 11), of end member 35.

Returning to FIG. 2, each of the compression members 44a and 44b are axially movable within the annular groove in the end member 35. As expansion agent is admitted into the spool body via the ports 39 for impregnation of tobacco in chamber 22, it is received into, and flows along axial channels 70 formed in the end member 35 and a portion of the expansion agent then flows into radial channels 59 and into the space 62 (FIG. 11) axially adjacent compression member 44b. Expansion agent is admitted into the space 60 (FIG. 11) axially adjacent compression member 44a via the portion of the annular space 26, which is located radially between the shell 14 and the end member 35, and axially between the impregnation chamber 22 and the compression member 44a. Additional expansion agent is also admitted into the space 62 adjacent compression member 44b via the portion of the annular space 26 located radially between the shell 14 and the end member 35, and axially between the sealing member 28b and the ports 39 in spool 16.

Figure 11:
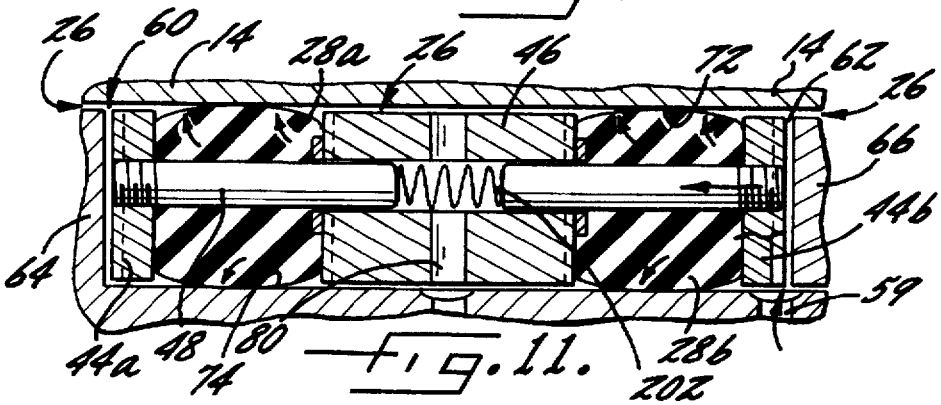
FIG. 11 is a detailed sectional view of the sealing assembly of FIGS. 3, 4, 8 and 9 shown with the elastic sealing member in its radially extruded condition.

As best seen in FIG. 11, the high pressure expansion agent which enters into the spaces 60 and 62 causes the compression members 44a and 44b to move axially, each towards its adjacent sealing member 28a and 28b, respectively and in the direction of spacer abutment ring 46. The resultant axial pressure applied to each of the sealing members 28a and 28b, causes each sealing member to extrude radially, i.e., expand radially, and thereby form a seal with the interior surface 72 (FIG. 11) of shell 14 and also with the bottom surface 74 (FIG. 11) of the annular groove supporting the sealing assembly in the end member 35. The expansion agent remains in the spaces 60 and 62 during the time in which tobacco in chamber 22 is impregnated with the expansion agent, and thus maintains the sealing members 28a and 28b in the expanded state during this time.

As seen from FIG. 3, the surface area of the annular end face 76a of each of the compression members 44a and 44b which is in fluid contact with the expansion agent, is larger than the surface area of the opposed end face 76b of each compression member 44a and 44b which, in turn, contacts and applies pressure to the elastically deformable sealing members 28a and 28b. This is achieved by the provision of the ports 50 through the elastic sealing members 28a and 28b which in effect, define areas on the end face 76b of each compression member that does not contact the sealing member. Accordingly, the compression members 44a and 44b each apply a greater contact pressure (in force per unit area) to the sealing rings 28a and 28b than is applied to each of the compression members by the expansion agent in the spaces 60 and 62.

In turn, when the sealing members extrude, i.e., expand radially, into sealing contact with the interior surface 72 (FIG. 11) of shell 14 and the bottom surface 74 (FIG. 11) of the annular groove in the end member, the sealing members contact these surfaces at a pressure which is the same as the pressure applied by each of the compression member end faces 76b to the annular end surfaces of the resiliently deformable sealing members 28a and 28b. Accordingly, the sealing members form seals between the interior of the shell and the peripheral surfaces of the spool end members at a sealing pressure exceeding the fluid pressure of the expansion agent. This allows the sealing members to seal against leakage of the expansion agent when the spool is in the impregnation position 18 even though the force used to expand the seals is derived from the pressure of the expansion agent.

The sealing rings can be formed of any of various high temperature stable, resiliently deformable materials as are used to form sealing rings, including carbon and graphite based materials commercially available as GRAFOIL. In one advantageous embodiment the sealing rings can be formed of an EDPM elastomer having a durometer hardness of between about 70 and 90, most preferably 80.

As seen in FIGS. 2, 3, 4 and 11, the spacer abutment ring 46 advantageously includes radially oriented ports 80 which communicate between the circumferential exterior and interior surfaces of the spacer abutment ring 46. The radial ports provide fluid communication at their exterior ends with the portion of the annular space 26 (FIG. 11) surrounding the ring 46 inside the shell 14. As seen in FIG. 4, the radial ports are also in fluid communication with the axial apertures 52 through the spacer abutment ring 46. The radial ports 80 through the ring 46 communicate at their interior ends with a plurality of radial ports 86 in the spool body shown in FIGS. 2, 4 and 10. The radial ports 86 through the spool body are fluidly connected to an axial port 88 extending through the spool body which terminates at a vent port 90 on the low pressure side of the spool body. The radial channels 80 thus allow venting of gasses trapped in the portion of the annular space 26 surrounding the spacer abutment member 46 and between the seals of the two sealing members 28a and 28b.

Figure 8:
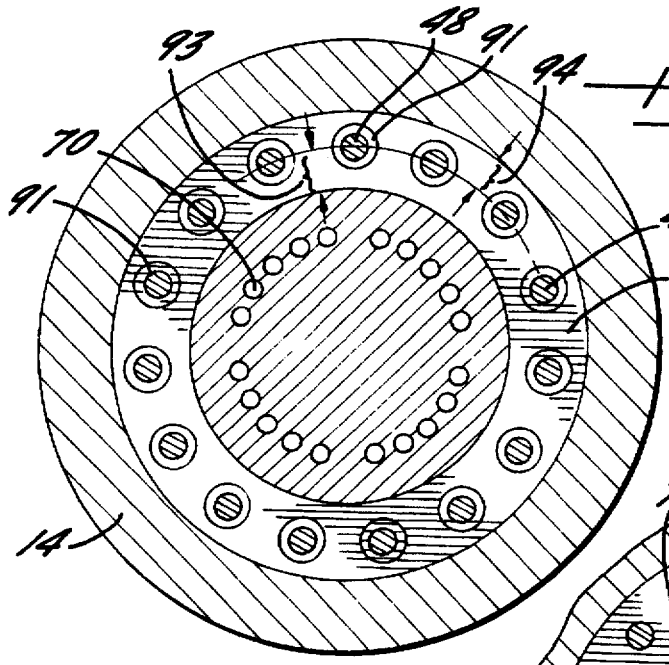
FIG. 8 is a partial cross-sectional view taken along line 8—8 of FIG. 4 illustrating a cross-sectional view of the end member of FIG. 4 and an end view of one resiliently deformable sealing member which is positioned about a portion of the circumferential exterior of the end member.

In the presently preferred embodiment of the invention, washers 91, best seen in FIGS. 3 and 8, are attached on both axial ends surfaces of each sealing member 28a–d to the areas thereof circumscribing each axial port 50. The washers 91 prevent the sealing member from extruding into and closing the ports 50 of the sealing member as it expands. It is also presently preferred to permanently bond the compression face of each compression member to the adjacent axial face of the respective sealing member, by any of various methods such as vulcanization, as also indicated in FIG. 3.

As indicated in FIG. 8 by distances 93 and 94, the pins 48 axially extending from the compression members, as well as the channels 50 through the sealing members 28a–b are preferably positioned radially closer to the circumferential exterior than to the circumferential interior of the sealing members 28*a* and 28*b*, and compression members 44*a* and 44*b*. Thus the distance 93 in FIG. 8 exceeds that indicated at 94. This preferred positioning of the pins equalizes the surface areas of the two radial portions of the compression member that contact the sealing member, i.e., the portion radially exterior to, and the portion radially interior to the pins 48. This is believed to ensure that as each of the sealing rings 28*a–b* expands radially, it will receive the same pressure contact at the various radial locations on its axial surface which, in turn, protects the pins 48 and/or washers 91 from being bent and/or warped from unequal pressure.

Figure 5:
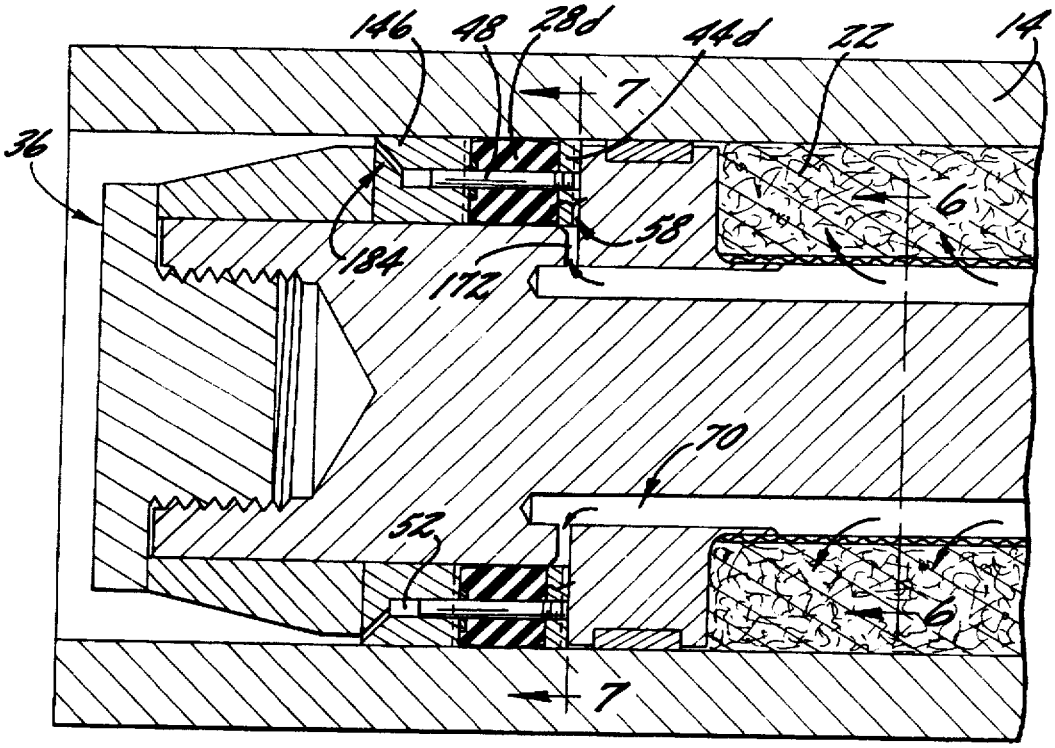
FIG. 5 is an enlarged detailed sectional view of the other end portion of the spool body of FIG. 2 positioned within the shell assembly.

The sealing assemblies 38*c* and 38*d* positioned adjacent the axial ends of the spool end members 35 and 36 respectively, and illustrated in FIGS. 4 and 5, are similar in construction and operation to the sealing assemblies 38*a* and 38*b*. Each of these sealing assemblies includes a sealing member 28*c* and 28*d* respectively, and a compression member, 44*c* and 44*d* respectively, carrying axially extending pins 48 thereupon. The pins 48 are arranged to extend through axial ports 50 in each sealing member 28*c* and 28*d* and also through ports 52 extending through an annular spacer abutment member 146 associated with each of the sealing members 28*c* and 28*d*. Each of the compression members 44*c* and 44*d* are axially movable, relative to its respective compression member within an annular groove in its respective end member 35 and 36.

Figure 7:
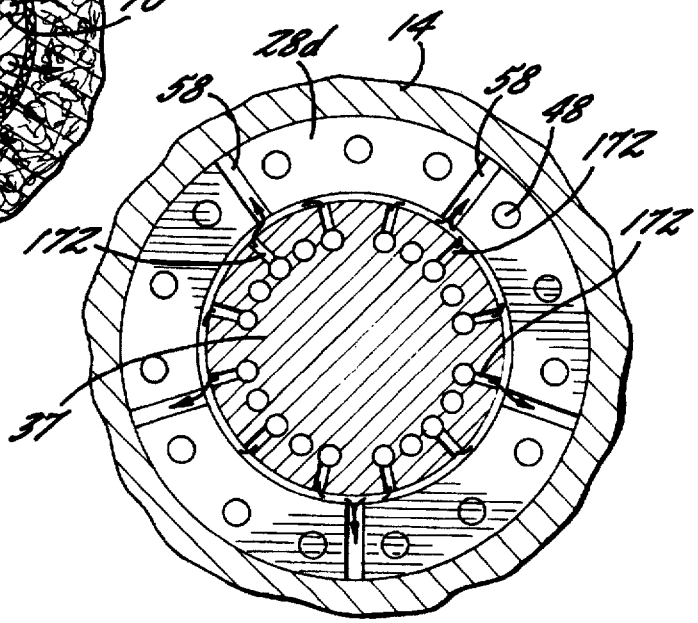
FIG. 7 is a partial cross-sectional view taken along line 7—7 of FIG. 5 illustrating an end view of an axially movable compression member which includes passages to allow entry of high pressure fluid into the space adjacent one annular end of the compression member to cause the compression member to move axially toward a resiliently deformable sealing member which is positioned adjacent the other annular end thereof.

As seen in FIGS. 2, 4, and 7, a portion of the expansion agent admitted into the spool body via ports 39 for impregnation of tobacco in chamber 22 is directed into and flows along ports 70 extending through spool 14 and then through radial ports 170 and 172 which communicate with radial channels formed in the annular end faces of compression members 44*c* and 44*d* respectively. Expansion agent is also admitted into the radial channels 58 formed in the annular end faces of compression members 44*c* and 44*d* via the portions of the annular space 26 surrounding each of the end members 35 and 36 and located axially between each of the sealing assemblies 38*c* and 38*d* and a space containing high pressure expansion agent. In the case of end member 35 the space containing high pressure expansion agent is the annular space between the shell 14 and the ports 39 in the spool body. In the case of end member 36 the annular space containing high pressure expansion agent is the annular space between the sealing member 28*d* and the impregnation zone 22.

As best shown in FIGS. 4 and 5, each of the spool end abutment rings 146 advantageously includes a plurality of blind radial ports 184 which communicate between the axial apertures 52 in the abutment rings and the non-pressurized space at the outer ends of the end members 35 and 36, respectively. The radial channels 184 allow venting of any gasses trapped in the axial apertures 52 in the abutment rings.

In a tobacco expansion operation, the expansion agent is introduced into the system through the high pressure gas supply line 29 and the ports 30 which communicate through the shell 14. These ports, which may be circumferentially distributed about the periphery of the shell 14, allow the introduction and removal of high pressure fluid into and out of the spool 16 when it is in the impregnation position. An exterior manifold 192 (FIGS. 2 and 4) surrounds the ports 30 and contains the expansion agent admitted to the shell 14 via the circumferential ports 30. The high pressure fluid flows through the ports 39 in end member 35 and then into the tobacco loaded and compressed about the spool connecting rod 37 via the axial ports and channels in the spool body.

Preferably, the expansion agent is propane at a pressure preferably above 2,000 psig, and more preferably between about 2,500 psig and 3,000 psig. The temperature of the propane in the chamber 22 is advantageously maintained above about 200° F., preferably between about 200° F. and 270° F., e.g., about 260° F. Under these conditions, extremely short impregnation times, between about 5 and about 15 seconds, can be used to impregnate tobacco while obtaining extremely desirable increases in tobacco filling capacity, for example, in excess of 50 to 100% increase in filling capacity.

Figure 6:
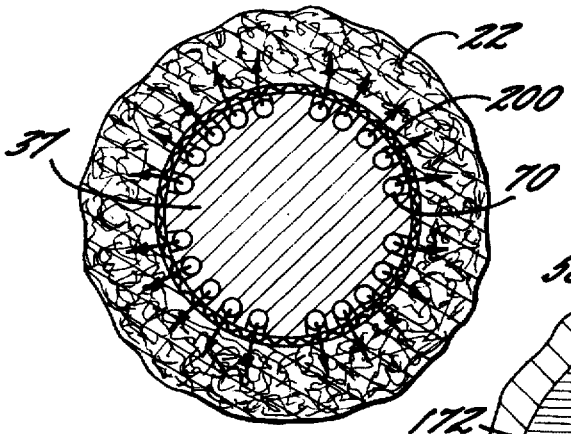
FIG. 6 is a cross-sectional view taken along line 6—6 of FIG. 5 and illustrating a charge of tobacco within the annular space surrounding the connecting rod of the spool body.

The expansion agent enters the ports 39 located within the end member 35 of the spool 16 and flows along axial channels 70 extending substantially the length of the connecting rod 37 of the spool 16 as schematically illustrated in FIG. 2. In the portion of the spool between end members 35 and 36, the axial channels 70 are open along their radial exterior surface and are covered by a cylindrical diffuser sleeve 200, best seen in FIGS. 5 and 6, which covers the channels 70 and prevents the entry of tobacco into the channels. The diffuser sleeve is formed of any of numerous high temperature stable materials, for example, several fusion-bonded layers of fine mesh metal screen, an apertured metal sleeve, a structural ceramic sleeve or the like, or other porous materials including screens or other apertured sheet materials. As illustrated in FIG. 6, the propane exits through the diffuser sleeve 200 into the tobacco in impregnation zone 22 for impregnation of same.

The radial expansion of the sealing members in sealing assemblies 38*a* and 38*b* during propane admittance to spool 14 is best illustrated in FIG. 11. In one preferred embodiment of the present invention, a spring 202 (FIG. 11) is provided between the axial ends of each set of axially aligned pins 48 within spacer abutment ring 46. The spring is shown in a compressed state in FIG. 11 as a result of movement of the compression members 44*a* and 44*b* toward each other. The spring 202 ensures return of the compression members 44*a* and 44*b* to a relaxed state following release of pressure, and can be particularly desirable to counteract any pressure caused by residual high pressure expansion agent that remains within the impregnation zone 22 following release of pressure. The springs are also desirable to counteract dragging of the pins 48 against the sealing members 28*a* and 28*b*. Although not shown in the drawings, springs 202 are also desirably provided for each of the pins 48 associated with the sealing assemblies 38*a*, and 38*d*.

Returning to FIG. 1, following introduction of propane expansion agent into the impregnator apparatus, the compressed impregnated tobacco is maintained under impregnated conditions for a short period of time ranging from less than about one second up to about twenty seconds. Thereafter, the pressure is released. Preferably, pressure release is substantially instantaneous, i.e., it is achieved in about one second or less. This can be achieved in part by employing a large port size, fast acting valve in the recovery pipes 32. A sensor (not shown) is advantageously provided for sensing pressure within the impregnator. When the pressure in impregnation 22 has dropped to a predetermined pressure at or near ambient pressure, the spool is moved to the unloading position 20 so that tobacco expansion can be effected. A pneumatic unloading device such as an oil-free compressor (not shown) is provided in the tobacco unloading zone and directs fluid such as high pressure air or nitrogen onto the tobacco surrounding spool 16 as the spool is moved to and from the unloading position 20. The tobacco removed in the unloading position 20 expands substantially instantaneously due to release of pressure. The expanded tobacco advantageously contains a substantial amount of moisture, i.e., 12 wt. % or greater.

As further illustrated in FIG. 1, the expanded tobacco which is removed at the unloading position 20 may thereafter be treated in a drying tower 34. Heated air, nitrogen, or the like is supplied via a supply pipe 210 and flows upwardly into the drying tower 34 to force the expanded tobacco upwardly into the drying tower 34 for a short period of time in order to remove moisture and stabilize the expansion of the tobacco. The drying tower is lined with a porous lining allowing the heated air or nitrogen used to dry the tobacco to be recirculated via line 214 and passed through a fan 216 and thereafter recirculated via supply pipe 218 for supply to pipe 210. If desired, make-up air can be added to the drying tower 34 via outside supply pipe 220.

In a preferred embodiment of the invention, the spool 16 is advantageously formed of one or more radially central components supporting a plurality of discreet annular components so that the sealing members 28 can easily be replaced. One preferred component spool is illustrated in FIGS. 2, 4 and 5. With reference to FIGS. 2 and 4, the spool is formed of a spool body 37 forming the connecting rod and a radially central portion of the two spool ends. The rod 37 has a plurality of integral threads 226 formed on its periphery at one or both axial ends. An annular shaped retaining member 228, provided with matching female threads 230 on its interior surface retains the three sealing assemblies 38*a*, 38*b* and 38*c* together with the annular inlet port component 232 in the proper positions on the main spool body 224. At the other end of the spool body, a second retaining member 232 is threadedly connected to an interior end portion of the radial control connecting rod 37. The retaining member 232 applies compressive force to a second retaining member 234 which retains the sealing assembly 38*d* in proper location on the radial central connecting rod 37. Replacement of worn sealing members can be achieved simply by removal of the retaining members 232 and 230. The sealing assemblies 38*a*, 38*b*, 38*c* and 38*d* can then be readily removed from the central component 37. New sealing members 28*a*–28*d* can be substituted for worn sealing members. The spool is then reassembled for continued use.

The spool of the invention is susceptible to numerous changes and variations. Although the spool has been illustrated for use in connection with a particular expansion agent, it will be apparent that numerous different expansion agents and processes can be employed in connection with the spool and shell apparatus disclosed herein. It will also be apparent that the spool and shell apparatus of the invention can be used in connection with numerous other processes employing an elevated pressure treating agent, including extraction processes applied to tobacco and other materials, and the like.

The invention has been described in considerable detail with reference to preferred embodiments. However many changes, variations, and modifications can be made without departing from the spirit and scope of the invention as described in the foregoing specification and defined in the appended claims.

We claim:

1. A spool and shell assembly for use in tobacco expansion comprising:

a pressure vessel defined by a tubular shell and a spool assembly moveable between at least a first position outside the shell and a treating position within the shell;

said spool assembly comprising first and second cylindrical end members and a connecting rod extending therebetween;

at least one sealing assembly carried by each of said first and second end members for sealing said pressure vessel when said spool is in the treating position;

each of said sealing assemblies comprising at least one elastically deformable annular sealing member associated with the circumferential exterior of said end member for sealing said spool in the treating position; and a pressure applying member operatively associated with at least one axial end of each of said sealing members for releasably imparting axial pressure on said axial end of said sealing member when said spool assembly is in said treating position to cause radial expansion of at least a circumferentially exterior portion of said deformable sealing member.

2. A spool and shell assembly according to claim 1 wherein said pressure applying member comprises an annular shaped member positioned axially adjacent said sealing member.

3. A spool and shell assembly according to claim 1 comprising a fluid inlet port in at least one of said end members for admitting fluid expansion agent into said pressure vessel, said fluid inlet port being fluidly connected to said pressure applying member to cause said expansion agent to apply fluid pressure to said pressure applying member.

4. A spool and shell assembly according to claim 2 comprising a fluid inlet port in at least one of said end members for admitting fluid expansion agent into said pressure vessel, said fluid inlet port being fluidly connected to said pressure applying member to cause said expansion agent to apply fluid pressure to said pressure applying member.

5. A spool and shell assembly according to claim 4 wherein said annular shaped pressure applying member comprises a first axial end surface contacting a first annular end surface of said sealing member and a second axial end surface in fluid communication with said expansion agent, and wherein the surface area of said second axial end surface is greater than the surface area of said first axial end surface.

6. A spool and shell assembly according to claim 5 further comprising at least one fluid vent communicating with a second axial surface of said sealing member for releasing fluid pressure applied to said second axial surface of said sealing member.

7. A spool and shell assembly according to claim 6 wherein at least one of said cylindrical end members comprises at least two sealing assemblies.

8. A spool and shell assembly according to claim 7 where said one of said end members comprises at least three sealing assemblies.

9. A spool and shell assembly according to claim 7 wherein said two sealing assemblies comprise an annular abutment member positioned between the sealing members of said two sealing assemblies and contacting a portion of said second axial end surfaces of said sealing members.

10. A spool and shell assembly according to claim 9, further comprising a vent line in fluid communication with an exterior portion of said spool assembly, said vent line extending through said annular abutment member for releasing fluid pressure applied to said second axial surfaces of said sealing members.

11. A spool and shell assembly according to claim 10 wherein said annular abutment member comprises radial channels communicating with the periphery thereof.

12. A spool and shell assembly according to claim 11 further comprising at least one biasing member associated with each of said sealing assemblies, said biasing member being arranged to assist release of pressure by said pressure applying member.

13. A spool and shell assembly according to claim 2 wherein said spool assembly is further moveable to an unloading position in addition to said loading and treating positions.

14. A spool and shell assembly according to claim 5 further comprising at least one axially directed pin connected to one axial end surface of each of said annular shaped pressure applying member and wherein at least a portion of said pin extends axially into said sealing member associated with said pressure applying member.

15. A spool and shell assembly according to claim 14 comprising a plurality of said pins connected to each of said pressure applying members.

16. A spool and shell assembly for use in treating a material with a fluid under conditions of elevated pressure comprising:

a pressure vessel defined by a tubular shell and a spool assembly moveable between at least a first position outside the shell and a treating position within the shell;

said spool assembly comprising first and second cylindrical end members and a connecting rod extending therebetween;

at least one sealing assembly carried by each of said first and second cylindrical end members for sealing said pressure vessel when said spool is in the treating position;

each of said sealing assemblies comprising an elastically deformable sealing ring associated with the circumferential exterior of said end member and an annular compression member positioned axially adjacent said sealing ring, said compression member being arranged for reciprocating axial movement towards and away from sealing member to provide radial expansion of said sealing member for sealing and unsealing of said spool assembly.

17. A spool and shell assembly according to claim 16 for impregnating tobacco loaded onto said spool at said first position with a tobacco expansion agent while said spool assembly is located in said second position and additionally comprising a tobacco expansion agent supply for supplying said expansion agent to said pressure vessel.

18. A spool and shell assembly according to claim 17 wherein said connecting rod comprises at least one axially extending fluid channel for delivering said expansion agent to said pressure vessel to impregnate the tobacco.

19. A spool and shell assembly according to claim 18 further comprising at least one radial channel in at least one of said end members for transferring said expansion agent from said expansion agent supply to said axially extending fluid channel.

20. A spool and shell assembly according to claim 19 further comprising a fluid supply channel in fluid communication with an axial surface of said compression member for supplying a fluid under elevated pressure to apply axial pressure on said compression member sealing assembly to cause radial expansion thereof.

21. A spool and shell assembly according to claim 20 wherein said annular shaped compression member comprises a first annular end surface contacting a first axial end surface of said sealing member and a second axial end surface in fluid communication with said expansion agent, and wherein the surface area of said second axial end surface is greater than the surface area of said first axial end surface.

22. A spool and shell assembly for use in impregnating tobacco with a tobacco expansion agent at elevated pressure comprising:

a pressure vessel including a cylindrical tubular shell and a spool assembly;

said spool assembly comprising first and second cylindrical end members and a connecting rod extending therebetween;

at least one sealing assembly carried by each of said first and second cylindrical end members for sealing said pressure vessel when said spool is in the treating position;

each of said sealing assemblies comprising at least one resiliently deformable annular sealing member associated with the circumferential exterior of at least one of said end members for sealing said spool in the treating position and an annular shaped compression member having a first axial surface of predetermined area contacting said sealing member and a second axial surface of surface area greater than said first axial surface and being arranged for fluid communication with said tobacco expansion agent.

23. A process for impregnating tobacco with a high pressure expansion agent comprising the steps:

loading tobacco into an annular space of a spool body defined by first and second cylindrical end members and a connecting rod extending therebetween;

moving said spool assembly into the interior of a tubular shell;

applying axial pressure to an resiliently deformable sealing ring associated with the circumferential periphery of each of said end members to thereby form a sealed annular impregnation zone within said tubular shell;

admitting expansion agent into said impregnation zone; and removing said expansion agent from said impregnation zone and releasing said axial pressure applied to said sealing members.

24. The process of claim 23 additionally comprising the step of contacting each of said resiliently deformable sealing members along one axial surface thereof with an annular compression member and contacting an annular end surface of said compression member with tobacco expansion agent to thereby cause said compression member to apply said axial pressure to said sealing members.

25. The process of claim 24 wherein said annular compression member comprises a first axial surface contacting said sealing member and a second axial surface contacting said expansion agent and wherein said second surface is of greater surface area than said first surface.

* * * * *